United States Patent [19]

Cramer

[11] 4,004,739

[45] Jan. 25, 1977

[54] CRUSHER AND MATERIAL SENSOR

[75] Inventor: Gerhardt H. Cramer, Portage, Mich.

[73] Assignee: Prab Conveyors, Inc., Kalamazoo, Mich.

[22] Filed: Oct. 24, 1975

[21] Appl. No.: 625,495

[52] U.S. Cl. ..... 241/34; 241/36; 222/66

[51] Int. Cl.[2] ..... B02C 25/00

[58] Field of Search ..... 241/33, 34, 36, 224, 241/248; 222/56, 58, 64, 65, 66

[56] References Cited

UNITED STATES PATENTS

| | | | |
|---|---|---|---|
| 1,892,790 | 1/1933 | Smelser | 222/66 X |
| 3,110,420 | 11/1963 | Brewer | 222/56 |
| 3,468,488 | 9/1969 | Karrer et al. | 241/34 |

*Primary Examiner*—Granville Y. Custer, Jr.
*Attorney, Agent, or Firm*—Dressler, Goldsmith, Clement, Gordon & Shore, Ltd.

[57] ABSTRACT

Apparatus for crushing swarf and like materials in which the material to be crushed is received in a supply hopper which includes sensing switch means responsive to material in the hopper reaching a selective level for enabling a control circuit which controls operation of the crusher.

8 Claims, 7 Drawing Figures

2.
64
30
34
32a
44
10
32b
14
24
16
20
22
29
26
12
40
28
18
42
36
56
32'''
72
52
32''
32'
70
43
46
50
48
32
60
62
64
49
58
54
66
69
68
68a

CRUSHER AND MATERIAL SENSOR

BACKGROUND OF THE INVENTION

The present invention relates to swarf crushers and similar structures in which material to be crushed is supplied to the crusher through a supply hopper supported thereon. Typically, such crushers operate for a time interval sufficient to process a load of material in the crusher and the cooperating hopper.

In order to control the operating cycle of the crusher, it has been the practice to utilize a small spot sensor in the hopper for determining when the hopper is filled to a desired level. The sensors which have been utilized have not been satisfactory and all too often have not provided the desired control of the crusher operation. They have not accurately sensed the level of material in the hopper even though the hopper was filled to the desired level.

SUMMARY OF THE INVENTION

In accordance with the present invention, there is provided a crusher for swarf and similar material having a chamber in which the material is crushed and including a material supply and storage hopper communicating with and supported on the crushing chamber. The hopper incorporates a suitable material sensing mechanism which is constructed to respond to material in the hopper reaching a selected level to positively ensure response to the material in the hopper and enable the control circuit for the crusher.

More specifically, in accordance with the present invention, a sensing switch forming a part of the control circuit for the crusher has a portion disposed within the hopper and extending a substantial distance about the periphery thereof to ensure responsiveness to materials in the hopper reaching the selected level. Such a sensor has sufficient surface area disposed within the hopper to ensure the sensing mechanism responding to material.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

DETAILED DESCRIPTION OF SPECIFIC EMBODIMENTS

Figures 1, 2, 3, 4, 5, 6:
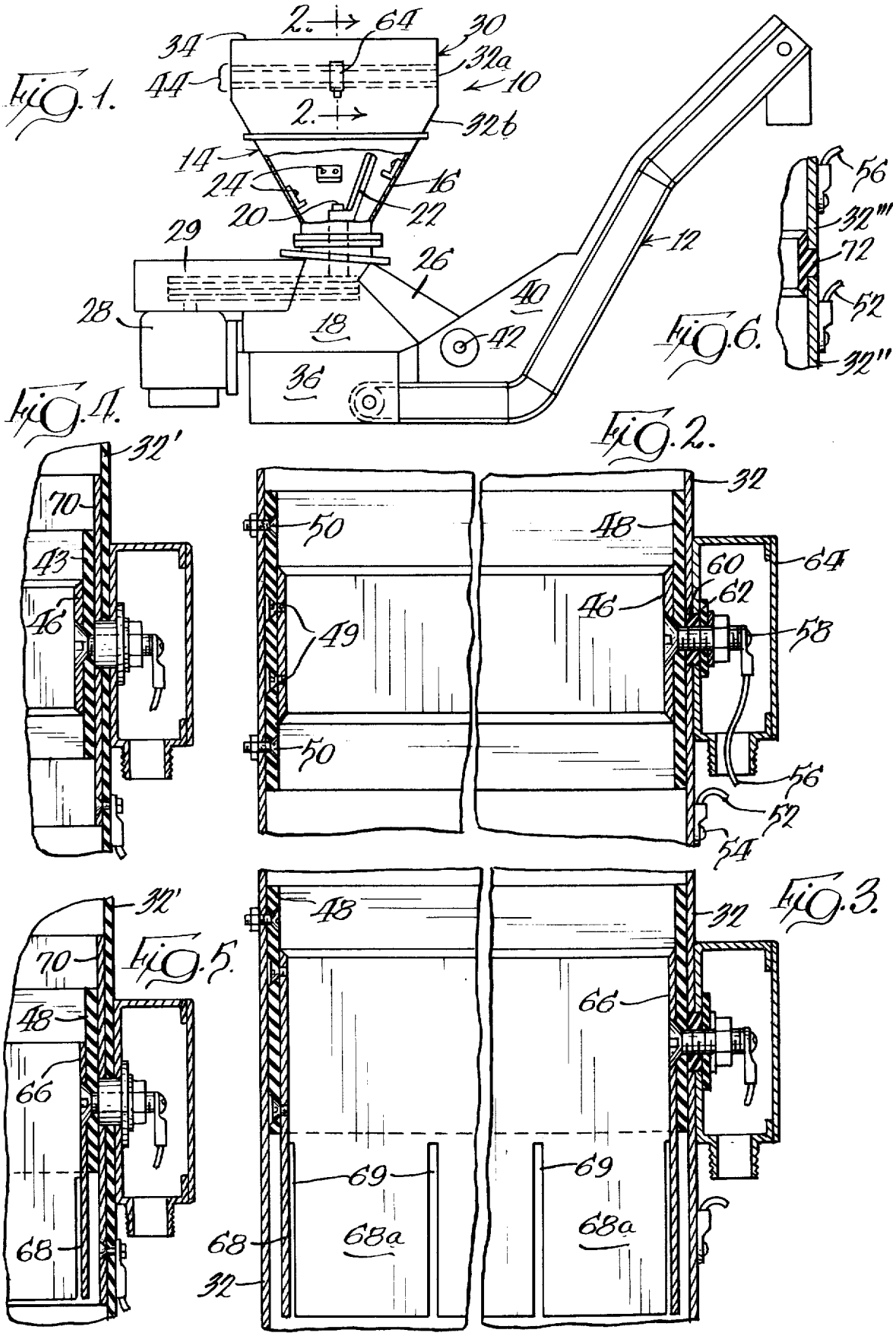
FIG. 1 is a diagrammatic view of a crushing apparatus incorporating the present invention.
FIG. 2 is an enlarged sectional view of a hopper taken along the lines 2—2 of FIG. 1.
FIG. 3 is a sectional view similar to FIG. 2 showing an alternative embodiment.
FIG. 4 is a partial sectional view similar to FIG. 2 showing a modification of the embodiment of FIG. 2.
FIG. 5 is a partial sectional view similar to FIG. 3 showing a modification of the alternative embodiment of FIG. 3.
FIG. 6 is a partial sectional view showing yet another alternative embodiment.

While this invention is susceptible of embodiment in many different forms, there is shown in the drawings and will herein be described in detail a preferred embodiment of the invention and modifications thereof, with the understanding that the present disclosure is to be considered as an exemplification of the principles of the invention and is not intended to limit the invention to the embodiments illustrated. The scope of the invention will be pointed out in the appended claims.

FIG. 1 shows one embodiment of a swarf crusher 10 and a discharge conveyor 12. This type of crusher is manufactured, for example, by Morgardshammar AB, of Sweden under the trademark ARBOGA. Such crushers are primarily intended to crush swarf, i.e., turnings of carbon steel, stainless steel, other alloyed steels, aluminum alloys, sponge iron, titanium and uranium although it may be used to crush other types of materials such as, e.g., plastics and glass.

The crusher 10 includes a generally conical crushing chamber 14 defined by a generally downwardly and inwardly tapered sidewall 16 and is open at the top for receiving material to be crushed. The open bottom of the crushing chamber 16 is supported on a suitable stand or base portion 18 through which extends a drive shaft 20 to which is affixed a crusher head 22. The crusher head 22 is rotated on the drive shaft and cooperates with stationary crusher members or cutters 24 affixed to the inner surface of the crushing chamber sidewall 16.

The open bottom of the crushing chamber 14 communicates with a discharge chute 26 affixed to and/or incorporated as a part of the base portion 18 for providing a discharge path for crushed material. The drive shaft 20 is driven by an electric motor 28 connected thereto through a suitable drive train 29.

Material to be crushed is introduced to the crushing chamber 14 through a material receiving and storage hopper 30 disposed above and supported on the crushing chamber 14. As seen in FIG. 1, the hopper 30 is formed by a sidewall 32 including an upper cylindrical sidewall portion **32*a* and a lower conical sidewall portion 32*b* which merges with the conical sidewall 16 of the crushing chamber 14. The hopper 30 which communicates through its open bottom with the crushing chamber 14, has an open top 34** for receiving material to be crushed.

Figure 7:
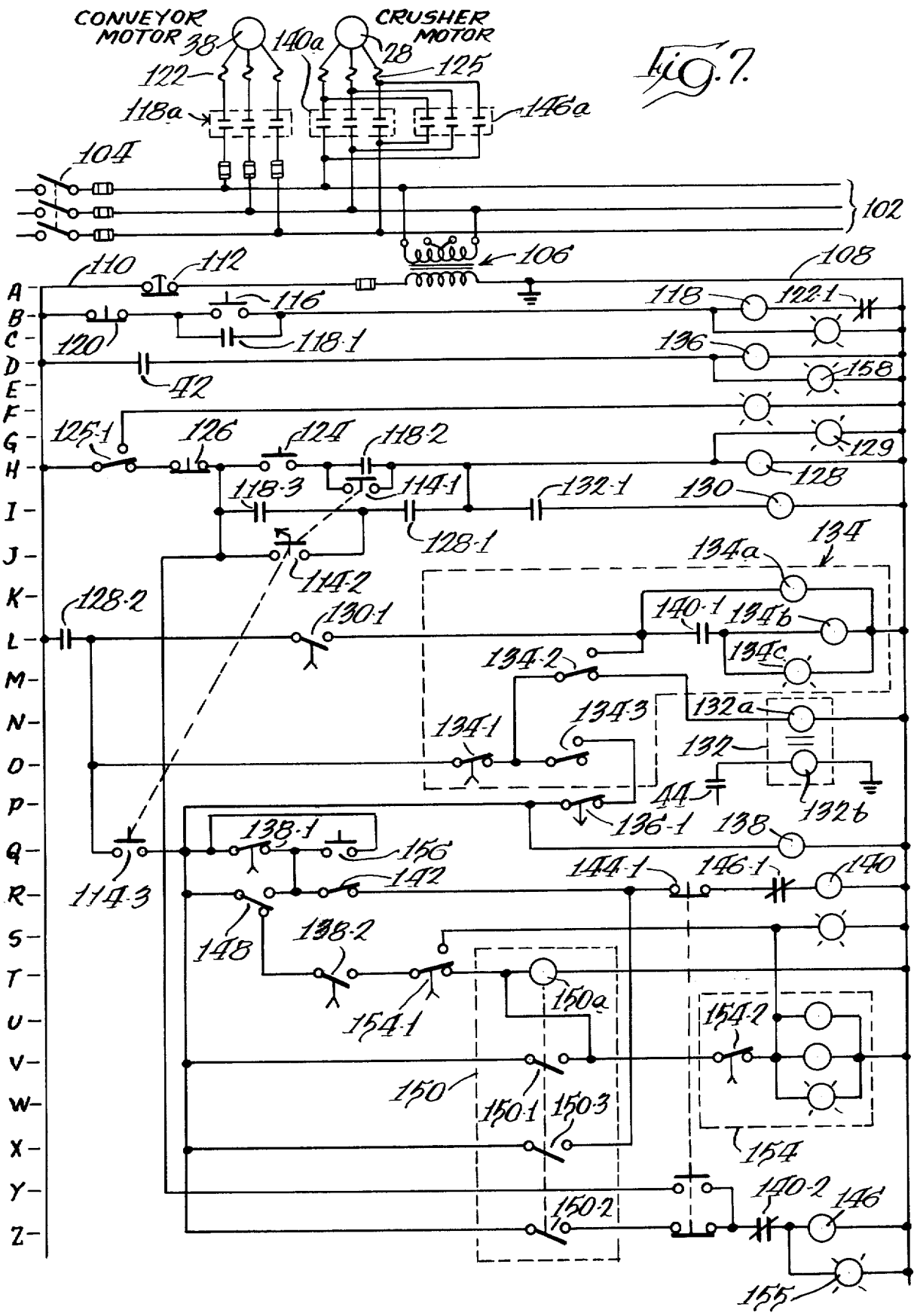
FIG. 7 is a diagram of a circuit for controlling operation of the crusher.

In the embodiment shown in FIG. 1, the base of the crusher is supported on a conveyor housing 36 disposed at one end of the discharge conveyor 12 driven by conveyor motor 38 (FIG. 7). A pair of spaced material retaining walls 40 (only one being shown) are disposed on either side of the conveyor 12 adjacent to the discharge chute 26 for retaining material deposited on the discharge conveyor 12.

A proximity switch 42 may be mounted in one of the conveyor retaining walls 40 for sensing an accumulation of crushed material on the conveyor 12 adjacent to the end of the discharge chute 26 and forms a part of the crusher control circuit (described in more detail below). The proximity or high level sensing switch 42 is operative to temporarily stop the crusher 10 thereby permitting the conveyor 12 to transport material away from the discharge chute 26 and prevent excessive accumulation of crushed material in the area adjacent to the high level switch 42 which might result in the material backing up into the crusher and inhibiting proper operation thereof or overflow of the material from the conveyor.

Typically, and in order to maximize the effeciency of operation of the crusher, the crusher is operated for a selected time interval which is sufficient to process a load of material disposed in the hopper 30 and crushing chamber 14. A level sensing mechanism or switch 44 is provided in the hopper 30, the switch 44 enabling the control circuit for the crusher when material in the hopper 30 reaches a selected level. The level switch 44, or the portion thereof disposed within the hopper 30, is adapted to be engaged by material in the hopper 30 when the hopper is filled to the selected level, thereby enabling the control circuit and permitting operation of the crusher 10. In existing structures, a spot-type sensor has been used which has proven to be relatively unreliable because material in the hopper often does not engage the sensor even though the hopper is full.

Referring to FIG. 2 there is shown an improved high level sensing mechanism 44 mounted on sidewall 32 of the hopper 30, which typically is constructed of an electrically conductive metal such as sheet steel. The sensing mechanism 44 includes a first switch contact or electrode in the form of a strip of electrically conductive material 46, such as brass, which extends peripherally about the entire inner surface of the hopper sidewall 32. The vertical dimension of the switch contact 46, its width or height, together with its substantial lateral dimension or length, provides a surface area sufficient to substantially preclude non-engagement therewith by material filling the hopper 30.

As shown in FIG. 2, the contact 46 is spaced from the electrically conductive hopper sidewall 32 by an insulating strip 48 to which it is affixed by suitable means such as bolts or screws 49. In the embodiment shown in FIG. 2, the insulating strip 48 extends above and below the contact to ensure electrical separation of the contact 46 and the hopper sidewall 32. The insulator is, in turn, attached to the sidewall such as, for example, by studs 50.

The electrode or contact 46 and the sidewall 32 of the hopper 30 act together as the normally open contacts of the level sensing switch 44. The hopper wall 32 is connected to the control circuit by a wire lead 52 suitably connected thereto such as by a conductive bolt 54 passing through one end of the wire and affixed to the sidewall 32. The electrode 46 is connected to the control circuit by another wire lead 56 affixed to one end of a conductive bolt 58 having conductive engagement with the electrode 46 and having the shaft passing through the sidewall 32 and insulated therefrom by suitable insulating gaskets 60 and spacers 62. As seen in FIG. 2, this portion of the switch 44 may be suitably encased in a protective housing 64.

In the embodiment shown in FIG. 2, the contacts of the level switch 44, the conductive brass strap electrode 46 on the one hand and the conductive hopper sidewall 32 on the other, are closed when the hopper is filled up to a level where the material in the hopper engages the brass electrode 46. Since, as indicated above, the crusher is primarily intended for metallic turnings, the engagement of the electrode 46 by the material within the hopper 30 completes an electrical circuit from the contact electrode 46, through the electrically conductive swarf to the hopper sidewall 32 to effectively close the level sensing switch 44 and enable the control circuit, as described in more detail below.

Alternatively, it may be desirable to construct the level sensor to provide an alternative for closing the switch which would be particularly useful when the material to be crushed is not electrically conductive or has low electrical conductivity. In this embodiment, shown in FIG. 3, the electrode 66 has a skirt portion 68 extending below the insulator 48. If the electrode 66 extends completely around the periphery of the inner surface of the sidewall 32, the skirt may be slotted at 69 into a plurality of skirt sections **68*a* to facilitate deflection of the skirt 68 directly against the conductive sidewall 32 when engaged by material in the hopper 30**.

The embodiments of FIGS. 1 and 2 may also be adapted for use with non-conductive sidewalls by interposing between the insulator 48 and the inner surface of the sidewall 32 an additional conductive electrode 70. The additional electrode is configured to make contact with either the swarf alone as shown in FIG. 4 or with either the swarf or the deflected skirt portion 68 as shown in FIG. 5.

Finally, as seen in FIG. 6, the conductive sidewall 32 could be divided into two segments 32'', 32''' separated by an insulating member 72. In this embodiment, the lower portion 32'' is one contact and the upper portion 32''' is the other.

The control circuit 100 enabled by the level sensor 44 is shown in FIG. 7.

The crusher motor 28 and the discharge conveyor motor 38 are connected through a main power line 102 to a suitable source (not shown) through a main power disconnect switch 104. The source is conveniently a three phase 440 volt source. The main power line 102 is connected to crusher motor 28 and the discharge conveyor motor 38 through appropriate contactors.

The main power line 102 is also connected to the primary of a transformer 106. The secondary of the transformer 106 is connected to a pair of main buss lines 108, 110 for supplying power to the control circuit 100. A manually operated master stop switch 112 is connected in one of the main buss lines 110 for manually disconnecting the control circuit 110 from the power line 102.

The control circuit 100 permits two modes of operation of the crusher, a run mode and a maintenance mode, determined by the run/maintenace switch 114 which is a two position switch having a first pair of contacts 114-1 (line H), a second pair of contacts 114-2 (line J) and a third pair of contacts 114-3 (line Q). In FIG. 7, the contacts of the run/maintenance switch 114 are shown open which is in the run position. In order to avoid an undesired accumulation of crushed material at the conveyor, when one is used, the crusher can not be started when the switch 114 is in the position shown, unless the discharge conveyor 12 is running. The control circuit 100 also precludes operation of the crusher 10 unless there is a sufficient amount of material in the hopper 30 to engage the level switch 44 and thereby enable the control circuit 100.

In addition, the control circuit 100 is effective to preclude operation of the crusher 10, or at least temporarily interrupt operation of the crusher, when there is an excessive accumulation of crushed material on the discharge conveyor 12 adjacent the discharge chute 26 all of which will be explained below.

When the switch 114 is in the maintenance position, i.e., the contacts 114-1, 114-2 and 114-3 are closed, permitting the crusher 10 to be started independently of the conveyor 12, without material in the hopper 30, and independently of any accumulation of material on the discharge conveyor 12.

In order to initiate operation of the crusher when switch 114 is in the position shown in FIG. 7, it is first necessary to start the conveyor 12 by closing the conveyor start switch 116 (line B). This energizes the conveyor motor starting coil 118 through the normally closed conveyor stop switch 120 and the normally closed contact 122-1 of the conveyor overload switch 122 (all in line B). The conveyor overload relay coil 112 is in the motor circuit.

When energized, the conveyor motor start coil 118 closes the contacts 118*a* of the contactor conveyor motor circuit, the normally open holding contacts 118-1 (line C) to maintain the starter coil 118 energized after release of the start switch 116, the normally open contacts 118-2 (line H) to enable crusher start switch 124, and normally open contacts 118-3 (line I) which operate as part of a bypass circuit to keep the crusher operating after it is started.

To start the crusher, the crusher forward start switch 124 (line H) is closed to complete a circuit through the now closed contacts 118-2, the normally closed contacts 125-1 of the crusher overload relay 125, and the normally closed crusher stop switch 126, to energize start relay coil 128 and the pilot light 129 connected across the start relay coil 128. The overload relay 125 is in the crusher motor circuit. When the start relay coil 128 (line H) is energized, it closes a first set of normally open contacts 128-1 (line I) which are connected in series with the contacts 118-3, closed when the conveyor motor coil 118 was energized, to bypass the crusher forward start switch 124 and maintain the start relay coil 128 energized after release of the start switch 124.

The start switch 124 and bypass circuit including contacts 118-3 and 128-1 are also connected to the timing relay coil 130 (line I) through the normally open contacts 132-1 of the level sensing relay 132 (lines N and O). Contacts 132-1 are closed when the relay 132 is energized in response to closure of the level sensing switch 44 in the hopper 30.

The energized start relay 128 also closes a set of normally open contacts 128-2 (line L) to enable the balance of the control circuit 100. Closure of the start relay contacts 128-2 completes a circuit (line 0) to the primary coil 132*a* of the level sensing induction relay 132 through the normally closed contacts 134-1 (line O) and 134-2 (line M) of the duration timer 134. The crusher 10 will begin to operate if the level sensing switch 44 connected to the secondary 132*b* of the level sensing relay 132 is closed, thereby closing the relay contacts 132-1 (line I) to energize the timing relay 130.

As explained below, the crusher 10 will continue to operate until the duration timer 134 times out, until the crusher 30 becomes jammed, until the motor 28 becomes overloaded, or until excess material accumulates on the discharge conveyor 12.

When the timing relay 130 (line I) is energized through the closed level relay contacts 132-1, the normally open timing relay contacts 130-1 (line L) will close approximately 5 seconds after the timing relay coil 132 is energized. This time delay prevents material being introduced into the hopper 30 and momentarily engaging the level switch 44 from energizing the crusher. In other words, the material must close switch 44 for a period of approximately 5 seconds, a good indication that the hopper is filled to the selected level, before the crusher will start.

When the timing relay contacts 130-1 (line L) close, the duration timer 134 is energized. The duration timer 134 includes a clutch 134*a*, which operates instantaneous timer contacts 134-2 (line M) and instantaneous contacts 134-3 (line O), and a timer motor 134*b* which operates delayed contacts 134-1 (line O). In addition, a timer pilot light 134*c* is connected across the motor 134*b* to show when the timer 134 is in operation.

Thus, upon energizing the duration timer 134, the instantaneous contacts 134-2 (line M) shift from the normally closed to the normally open position to de-energize the primary 132*a* of the running level relay 132 and to maintain the duration timer 134 energized. When the primary 132*a* of the running level induction relay 132 is de-energized, the induction relay contacts 132-1 (line I) open to de-energize the timing relay coil 130, thereby opening the timing relay contacts 130-1 (line L).

The second set of instantaneous duration timer contacts 134-3 (line O) also shift to the normally open position to energize through the normally closed conveyor high level relay contacts 136-1 (line P) a second timing relay coil 138 (line Q) and the crusher forward motor coil 140 (line R) through the normally closed second timing relay contacts 138-1 (line Q), the normally closed contacts of a first crusher run sense switch 142, the normally closed contacts 144-1 of manual reverse jog switch 144 and the normally closed contacts 146-1 of the reverse motor coil 146.

When the forward motor coil 140 is energized, it closes the contacts 140*a* of the crusher motor connector to initiate forward rotation of the crusher motor 28, and closes contacts 140-1 (line L) to start the duration timer motor 134*b*, and also opens the normally closed contacts 140-2 (line Z) to preclude energizing the reverse motor coil 146.

When the crusher begins to operate, a second crusher run sense switch 148 (line R) moves from the normally closed to the normally open position to bypass the normally closed contacts 138-1 of the second timing relay 138 which contacts open approximately 4 seconds after the second timing relay 138 is energized. This delay permits the second run sense switch 148 to shift to the normally open position.

The energized second timing relay 138 also closes normally open contacts 138-2 (line T) after an approximate 4 second delay to enable the jam control and timing circuit, to be described in more detail below.

In normal operation, the forward motor coil 140 (line R) will remain energized and the crusher will continue to run until the duration timer 134 times out. At the end of the timing interval, which is adjustable, the duration timer 134 times out opening the delayed contacts 134-1 (line O). When the delayed duration timing contacts 134-1 open, the duration timer clutch 134*a* is de-energized. As a result, the instantaneous duration timer contacts 134-2 and 134-3 return to their normally closed position to de-energize the forward motor coil 140 and to enable the primary coil 132*a* of the running level relay 132.

When the clutch 134*a* is de-energized, the delayed duration timer contacts 134-1 are reset to complete the circuit through the primary coil 132*a* of the running level relay 132. When the crusher stops, the second run sense switch 148 returns to its normally closed position, but the jam timer is not energized since the second timing relay 138 has also been de-energized when timer contacts 134-3 (line O) return to their normally closed position.

Since the start relay coil 128 (line H) and the conveyor motor coil 118 (line B) remain energized, the control circuit 100 will recycle when the hopper is filled to the level sufficient to close the running level switch 44 in the secondary **132*b* of the running level relay 132, thereby again closing the relay contacts 132-1** (line I) to repeat the cycle described above.

If the crusher 10 becomes jammed, the drive shaft 20 will stop even though the forward motor coil 140 is energized. When this occurs, the second run sense switch 148 (line R) returns to its normally closed position. This results when timing relay contacts 138-1 (line Q) are opened in de-energizing the forward motor coil 140, thereby opening the contacts 140-1 (line L) temporarily terminating operation of the duration timer motor **134*b* to interrupt the timing cycle, and closing the contacts 140-1 (line Z) to the reverse motor coil 146**.

Since the second timing relay coil 138 (line Q) remains energized, thereby closing contacts 138-2 (line T), the normally closed contacts of the run sense switch 148 complete a circuit through the motor **150*a* (line T) of a jam cycle timer 150. The jam cycle timer motor 150*a* when energized controls the operation of three cam operated switches 150-1 (line V), 150-2 (line Z), and 150-3 (line X). The first switch 150-1 closes approximately 1.8 seconds after the cycle 150*a* is energized to maintain the motor 150*a* energized, and to complete a circuit to jam duration timer 154. The switch 150-1** remains closed for approximately 9 seconds, the jam timing cycle.

The second cycle timing switch 150-2 closes at about the same time as the first switch 150-1 to energize the reverse motor coil 146 and pilot light 155 connected across the motor coil 146. When the reverse motor coil 146 is energized, it closes contacts **146*a* in the crusher motor circuit and opens normally closed contacts 146-1 connected in series with the forward motor coil 140 to preclude energization thereof. The second cycle timing switch 150-2** remains closed for approximately 4 seconds so that the crusher will run in reverse for that period of time.

Approximately 5 seconds after the cycle timer 150 is energized, the second switch 150-2 opens and the third cycle timing switch 150-3 is closed to re-energize the forward motor coil 140. The second run sense switch shifts from the normally closed to the normally open position to hold the forward motor starter coil 140 energized. If, as a result of this action, the jam is cleared, the normally open contacts of the second run sense switch remain closed and the crusher will continue to run forward until the duration timer times out as explained above.

The jam cycle timer 150 times out after approximately 9 seconds thereby opening the first and third cycles switches 150-1 and 150-3, respectively, and de-energizing the jam timer 150, if the crusher is unjammed and is running in the forward direction. If, however, the crusher is still jammed when the cycle timer runs out, the normally closed contacts of the second run sense switch 148 remain closed, keeping the cycle timer 150 and jam timer 154 energized and repeating the jam cycle.

If after a period of time, for example, approximately three cycles of the cycle timer 150, the crusher is not unjammed, the jam timer 154 will time out opening the delayed contacts 154-1 (line T) and 154-2 (line V) to energize the jam indicator light 156 and maintain the jam timer clutch energized.

Since the forward motor coil 140 is de-energized under these circumstances, the forward motor coil contacts 140-2 (line L) are open to interrupt the duration timer 134. In order to restart the crusher after the jam is cleared, a manual reset switch 156 (line G) may be closed, or alternatively the entire control circuit may be reset by operating the crusher stop button 126 (line H). If reset, the hopper must be refilled to a sufficient level to close the level switch 44 and to initiate a complete operating cycle.

If either of the motors 28 or 38 becomes overheated, the corresponding thermal overload relay 122, 125, respectively operates overload contacts 122-1 or 125-1. In either case, the entire control circuit is de-energized and reset.

Finally, if material accumulates in the crusher discharge conveyor to a high enough level to activate the high level detection switch 42 (line D), the switch is closed to energize the high level relay 136 and high level indicator light 158. The energized high level relay opens the normally closed high level relay contacts 136-1 (line P) to de-energize the second timing relay coil 138 and the forward motor coil 140. When the level of material in the discharge conveyor drops low enough to open the high level proximity switch 42, the high level relay is de-energized. The relay contacts 136-1 close approximately 5 seconds thereafter, thereby allowing the accumulation of material in the conveyor to drop even lower, to re-energize the second timing relay 138, the forward motor coil 140, and the duration timer 134.

Thus there has been disclosed, a crusher for swarf and similar material in which the control circuit therefor is enabled in response to material in the hopper reaching a selected level, and in which the switch means for sensing material in the hopper is constructed to ensure that the material is sensed in order to properly enable the control circuit under the selected conditions.

From the foregoing, it will be observed that numerous variations and modifications may be effected without departing from the true spirit and scope of the novel concept of the invention. It is, of course, intended to cover by the appended claims all such modifications as fall within the scope of the claims.

What is claimed is:

1. Apparatus for crushing swarf and like materials comprising:

a crushing chamber for the material to be crushed, said crushing chamber having a loading opening to receive the material to be crushed and having means for discharging crushed material;

crushing means disposed within said crushing chamber;

motor means operable for driving said crushing means to effect crushing of material within said crushing chamber;

a supply hopper for receiving and storing material to be crushed, disposed above said crushing chamber and formed by sidewall means defining an open top and an open bottom communicating with the loading opening of the crushing chamber;

electrical control circuit connected to said motor means for controlling the operation thereof; said electrical control circuit including a normally open switch means having a pair of contacts and responsive to material in said hopper reaching a selected level for enabling said electrical control circuit;

at least a portion of said switch means being disposed internally of and supported within said hopper and extending about the periphery thereof, and one of said switch contacts being disposed along the inner surface of said sidewall means and normally electrically insulated from the other of said switch contacts;

said one switch contact being positioned for engagement by material filling said hopper as aforesaid, and the surface area of said switch portion being sufficient to insure said switch means responding to material filling said hopper as aforesaid;

whereby said switch is closed in response to said engagement of said one switch contact by material in said hopper for enabling said control circuit.

2. Apparatus as claimed in claim 1 wherein:

said one contact includes a band of electrically conductive material supported on said inner surface of said sidewall means.

3. Apparatus as claimed in claim 2 wherein:

said one contact is a single band of conductive material extending substantially around the entire periphery of the inner surface of said sidewall means.

4. Apparatus as claimed in claim 3 wherein:

said hopper sidewall means is electrically conductive and comprises the second of said switch contacts.

5. Apparatus as claimed in claim 4 including:

insulating means disposed between said one switch contact and said hopper sidewall means to prevent electrical contact therebetween, said switch being closed through electrically conductive material within said hopper engaging both said sidewall means and said one switch contact.

6. Apparatus as claimed in claim 4 including:

insulating means disposed between at least a portion of said one contact and said sidewall means for normally preventing electrical contact therebetween;

said one contact having a portion movable in response to engagement by material in said hopper for engaging said sidewall means to close said switch means.

7. Apparatus as claimed in claim 6 wherein:

said one contact has a skirt portion depending below said insulating means and normally spaced from said sidewall means, said skirt means being segmented to permit deflection thereof into electrical contact with said sidewall means in response to engagement by said material in said hopper.

8. Apparatus as claimed in claim 1 wherein:

said hopper sidewall means is conductive;

and including:

electrical insulating means separating said hopper sidewall means into two portions electrically insulated from each other;

each of said portions comprising one of said contacts;

whereby said switch is closed in response to electrically conductive material in said hopper spanning said insulating means and engaging both of said sidewall portions.

* * * * *